US011598600B2

(12) United States Patent
Landies, III et al.

(10) Patent No.: US 11,598,600 B2
(45) Date of Patent: Mar. 7, 2023

(54) QUICK-CHANGE BARREL FOR A FIREARM

(71) Applicant: Ohio Ordnance Works, Inc., Chardon, OH (US)

(72) Inventors: Robert W. Landies, III, Chardon, OH (US); Thomas M. Hardman, Chesterland, OH (US); Brent Susnik, Twinsburg, OH (US); Samuel D. Reid, Chardon, OH (US)

(73) Assignee: Robert W. Landies, III, Chardon, OH (US)

( * ) Notice: Subject to any disclaimer, the term of this patent is extended or adjusted under 35 U.S.C. 154(b) by 0 days.

(21) Appl. No.: 17/160,765

(22) Filed: Jan. 28, 2021

(65) Prior Publication Data

US 2022/0236029 A1 Jul. 28, 2022

(51) Int. Cl.
*F41A 21/48* (2006.01)

(52) U.S. Cl.
CPC ..... *F41A 21/484* (2013.01)

(58) Field of Classification Search
CPC ..... F41A 21/48; F41A 21/481; F41A 21/484
USPC ..... 42/75.02
See application file for complete search history.

(56) References Cited

U.S. PATENT DOCUMENTS 1,494,524 A * 5/1924 Adamson ..... F41A 21/00 285/391
1,994,489 A * 3/1935 Simpson ..... F41A 21/484 42/1.07
4,685,235 A * 8/1987 Bunning ..... F41A 21/481 89/14.05
5,802,755 A * 9/1998 Tortorici ..... F41A 13/08 89/37.11
9,448,027 B1 * 9/2016 Zinsner ..... F41A 21/482
9,964,374 B1 * 5/2018 Facchini ..... F41A 11/02
2007/0074437 A1 * 4/2007 Compton ..... F41C 27/06 42/12
2014/0115938 A1 * 5/2014 Jarboe ..... F41C 23/16 42/71.01
2015/0007478 A1 * 1/2015 Barrett ..... F41A 3/66 42/75.02
2021/0164750 A1 * 6/2021 Wutte ..... F41A 21/481

OTHER PUBLICATIONS

MG-42 SA Owner's Manual Belt-Fed Semi-Automatic Rifle; MG-42 SA Rev. 2, p. 18.
U.S. Ordnance Operator's Manual, Heavy Machine Gun, .50 Cal, M2HB/QCB.

* cited by examiner

*Primary Examiner* — Bret Hayes
(74) *Attorney, Agent, or Firm* — Renner Kenner Greive Bobak Taylor & Weber

(57) ABSTRACT

A firearm includes a quick-change barrel including: (a) at least two barrel-mounting features, each configured to selectively interact with a barrel-receipt feature of the firearm during mounting of the quick-change barrel to a mounting structure of the firearm, or (b) at least one barrel-mounting feature configured to selectively interact with at least two barrel-receipt features of the firearm during mounting of the quick-change barrel to a mounting structure of the firearm. The barrel is selectively mountable to the firearm in at least two orientations depending, per (a), upon which of the at least two barrel-mounting features interact with the barrel-receipt feature or, per (b), upon which of the at least two barrel-receipt fixtures interact with the barrel-mounting fixture.

18 Claims, 6 Drawing Sheets

QUICK-CHANGE BARREL FOR A FIREARM

FIELD OF THE INVENTION

The present invention relates to detachable barrels for firearms. More particularly, the present invention relates to a quick-change barrel having at least two selectable orientations for mounting to the firearm.

BACKGROUND OF THE INVENTION

The prior art includes quickly changed detachable barrels for firearms, but they either include only one mounting orientation (for example in the Quick-Change Barrel M2HB-QCB), or require the manipulation of a locking or retaining mechanism to allow for the barrel to be changed (for example in MG42, MG74, and MG3 machine guns). This is an area for improvement in firearm design, and the present invention addresses this need for improvement.

SUMMARY OF THE INVENTION

An embodiment of the present invention provides a firearm comprising a quick-change barrel including: (a) at least two barrel-mounting features, each configured to selectively interact with a barrel-receipt feature of the firearm during mounting of the quick-change barrel to a mounting structure of the firearm or (b) at least one barrel-mounting feature configured to selectively interact with at least two barrel-receipt features of the firearm during mounting of the quick-change barrel to a mounting structure of the firearm, such that the quick-change barrel is selectively mountable to the firearm in at least two orientations depending, per (a), upon which of the at least two barrel-mounting features interact with the barrel-receipt feature or, per (b), upon which of the at least two barrel-receipt fixtures interact with the barrel-mounting fixture.

Another embodiment of the present invention provides a firearm as in any embodiment above, further comprising at least one tactile feature positioned relative to at least one of the barrel-mounting features so as to indicate a correct barrel orientation for initial insertion of the quick-change barrel in the barrel-receipt feature.

Another embodiment of the present invention provides a firearm as in any embodiment above, wherein (a) the at least two barrel-mounting features include a first barrel slot and a second barrel slot, and the barrel-receipt feature is an alignment stud, or wherein (b) the at least two barrel-receipt features include a first barrel support slot in the firearm and a second barrel support slot in the firearm, and the at least one barrel-mounting feature is an alignment stud.

Another embodiment of the present invention provides a firearm as in any embodiment above, wherein the quick-change barrel further comprises barrel locking flanges configured to engage locking flanges provided by the mounting structure.

Another embodiment of the present invention provides a firearm as in any embodiment above, wherein the mounting structure is a barrel extension.

Another embodiment of the present invention provides a firearm as in any embodiment above, wherein the quick-change barrel includes at least two barrel-mounting features including a first barrel slot and a second barrel slot, and the barrel-receipt feature is an alignment stud, and the barrel locking flanges include at least two sets of locking flanges extending radially at a mounting end of the quick-change barrel, the locking flanges being spaced circumferentially about the insertion end.

Another embodiment of the present invention provides a firearm as in any embodiment above, wherein each set of the at least two sets of locking flanges are positioned circumferentially about the quick-change barrel, between two of the at least two barrel-mounting features.

Another embodiment of the present invention provides a firearm as in any embodiment above, wherein the first barrel slot comprises: a first slot entrance section; a first circumferential section; a first cycle section; wherein the first slot entrance section extends axially along the length of the barrel and is in communication with the first circumferential section, wherein the first circumferential section is in communication with the first cycle section, and wherein the first cycle section is oriented axially with the length of the barrel, wherein the second barrel slot comprises: a second slot entrance section; a second circumferential section; a second cycle section; and wherein the second slot entrance section extends axially along the length of the barrel and is in communication with the second circumferential section, wherein the second circumferential section is in communication with the second cycle section, and wherein the second cycle section is oriented axially with the length of the barrel.

Another embodiment of the present invention provides a firearm as in any embodiment above, wherein when the quick-change barrel is in a locked position, the alignment stud is in communication with the first cycle section or the second cycle section.

Another embodiment of the present invention provides a firearm as in any embodiment above, wherein the firearm includes a barrel retaining spring, and the quick-change barrel further comprises a first notch and a second notch, both for selectively interacting with the barrel retaining spring.

Another embodiment of the present invention provides a firearm as in any embodiment above, wherein the quick-change barrel further comprises a first feed ramp, a second feed ramp, wherein the first feed ramp is positioned relative to the first barrel slot for alignment with the locking tip of the barrel retaining spring during installation of the quick-change barrel in a first orientation of the at least two orientations, wherein the second feed ramp is positioned relative to the second barrel slot for alignment with the locking tip of the barrel retaining spring during installation of the quick-change barrel in a second orientation of the at least two orientations, a first landing, wherein the first landing is positioned behind the first feed ramp and is circumferentially adjacent to the first notch, and a second landing, wherein the second landing is positioned behind the second feed ramp and is circumferentially adjacent to the second notch.

Another embodiment of the present invention provides a firearm as in any embodiment above, wherein the locking tip includes a beveled lead end configured to (a) ramp over the first feed ramp onto the first landing and engage the first notch upon rotation of the quick-change barrel into the locked position in the first orientation, and (b) ramp over the second feed ramp onto the second landing and engage the second notch upon rotation of the quick-change barrel into the locked position in the second orientation.

Another embodiment of the present invention provides a firearm as in any embodiment above, wherein the quick-change barrel is configured so that the quick-change barrel can be mounted to and removed from the firearm without requiring the actuation or manipulation of any push buttons, levers, handles, rings, locking mechanisms, retainers, holders, aligners, or the opening, closing or manipulation of any partitions, doors, receiver sections, covers, guards, or anything else designed or intended to act as a barrel retaining or position holding/locking device.

Another embodiment of the present invention provides a firearm as in any embodiment above, where the quick-change barrel can be mounted to or removed from the firearm with a push-and-twist movement.

An embodiment of the present invention provides a quick-change barrel for a firearm comprising at least two barrel-mounting features, each configured to selectively interact with a barrel-receipt feature of the firearm during mounting of the quick-change barrel to the firearm, such that the quick-change barrel is selectively mountable to the firearm in at least two orientations depending upon which of the at least two barrel-mounting features interact with the barrel-receipt feature.

Another embodiment of the present invention provides a quick-change barrel as in any embodiment above, wherein the at least two barrel-mounting features include a first barrel slot and a second barrel slot.

Another embodiment of the present invention provides a quick-change barrel as in any embodiment above, wherein the first barrel slot comprises: a first slot entrance section; a first circumferential section; a first cycle section; wherein the first slot entrance section extends axially along the length of the barrel and is in communication with the first circumferential section, wherein the first circumferential section is in communication with the first cycle section, and wherein the first cycle section is oriented axially with the length of the barrel; wherein the second barrel slot comprises: a second slot entrance section; a second circumferential section; a second cycle section; and wherein the second slot entrance section extends axially along the length of the barrel and is in communication with the second circumferential section, wherein the second circumferential section is in communication with the second cycle section, and wherein the second cycle section is oriented axially with the length of the barrel.

An embodiment of the present invention provides a firearm comprising at least two barrel-receipt features, each configured to selectively interact with a barrel-mounting feature of a quick-change barrel during mounting of the quick-change barrel to a mounting structure of the firearm, such that the firearm can selectively receive a quick-change in at least two mounted orientations depending upon which of the at least two barrel-receipt fixtures interact with the barrel-mounting fixture.

Another embodiment of the present invention provides a firearm as in any embodiment above, wherein the at least two barrel-receipt features include a first barrel slot and a second barrel slot.

Another embodiment of the present invention provides a firearm as in any embodiment above, wherein the first barrel slot comprises: a first slot entrance section; a first circumferential section; a first cycle section; wherein the first slot entrance section extends axially along the length of the firearm and is in communication with the first circumferential section, wherein the first circumferential section is in communication with the first cycle section, and wherein the first cycle section is oriented axially with the length of the firearm; wherein the second barrel slot comprises: a second slot entrance section; a second circumferential section; a second cycle section; and wherein the second slot entrance section extends axially along the length of the firearm and is in communication with the second circumferential section, wherein the second circumferential section is in communication with the second cycle section, and wherein the second cycle section is oriented axially with the length of the firearm.

DETAILED DESCRIPTION OF ILLUSTRATIVE EMBODIMENTS

Figure 1:
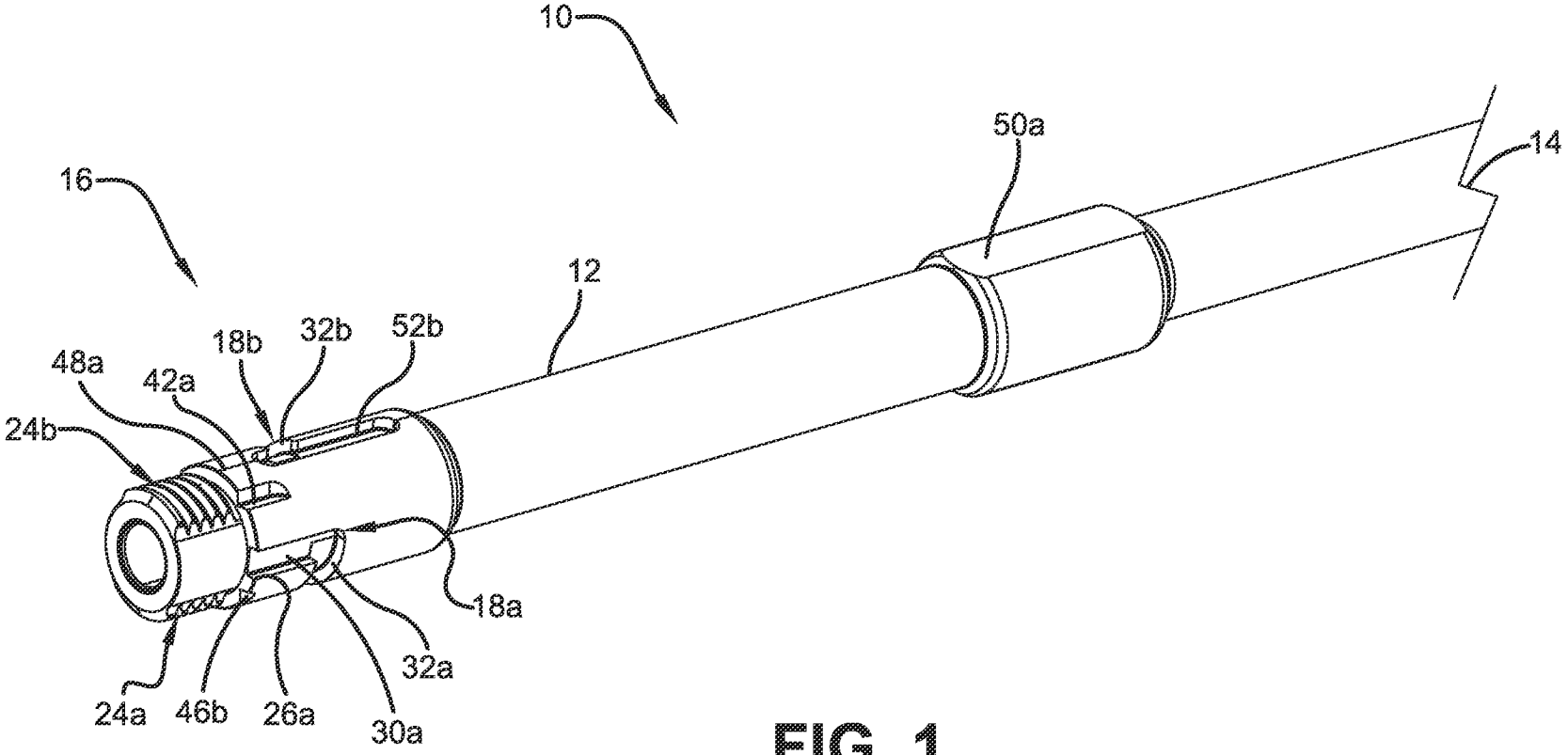
FIG. 1 is a perspective view of relevant portions of a quick-change barrel in accordance with this invention.
Figure 2:
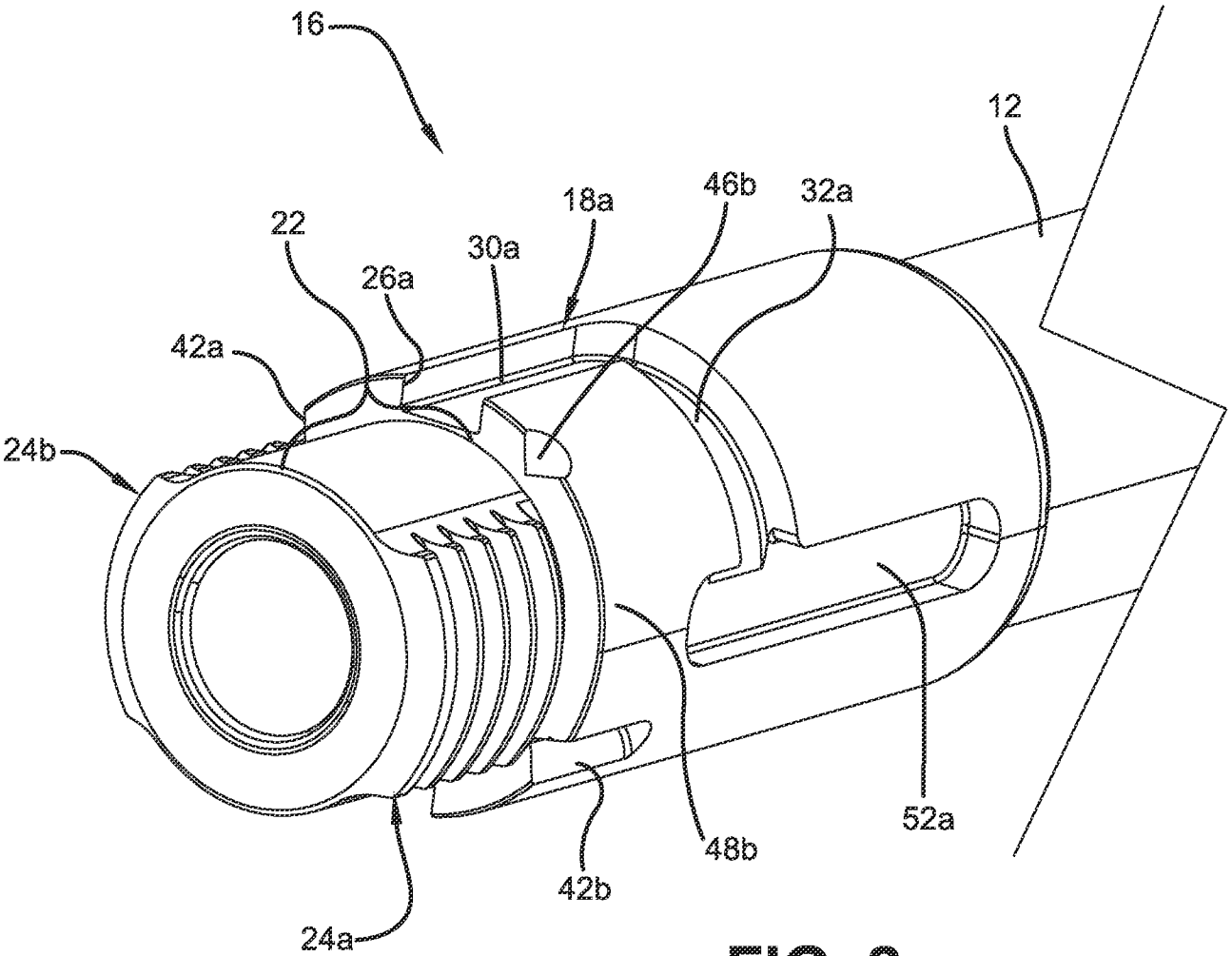
FIG. 2 is a perspective view as in FIG. 1, but rotated to show more particularly a second barrel slot of the quick-change barrel.
Figure 3:
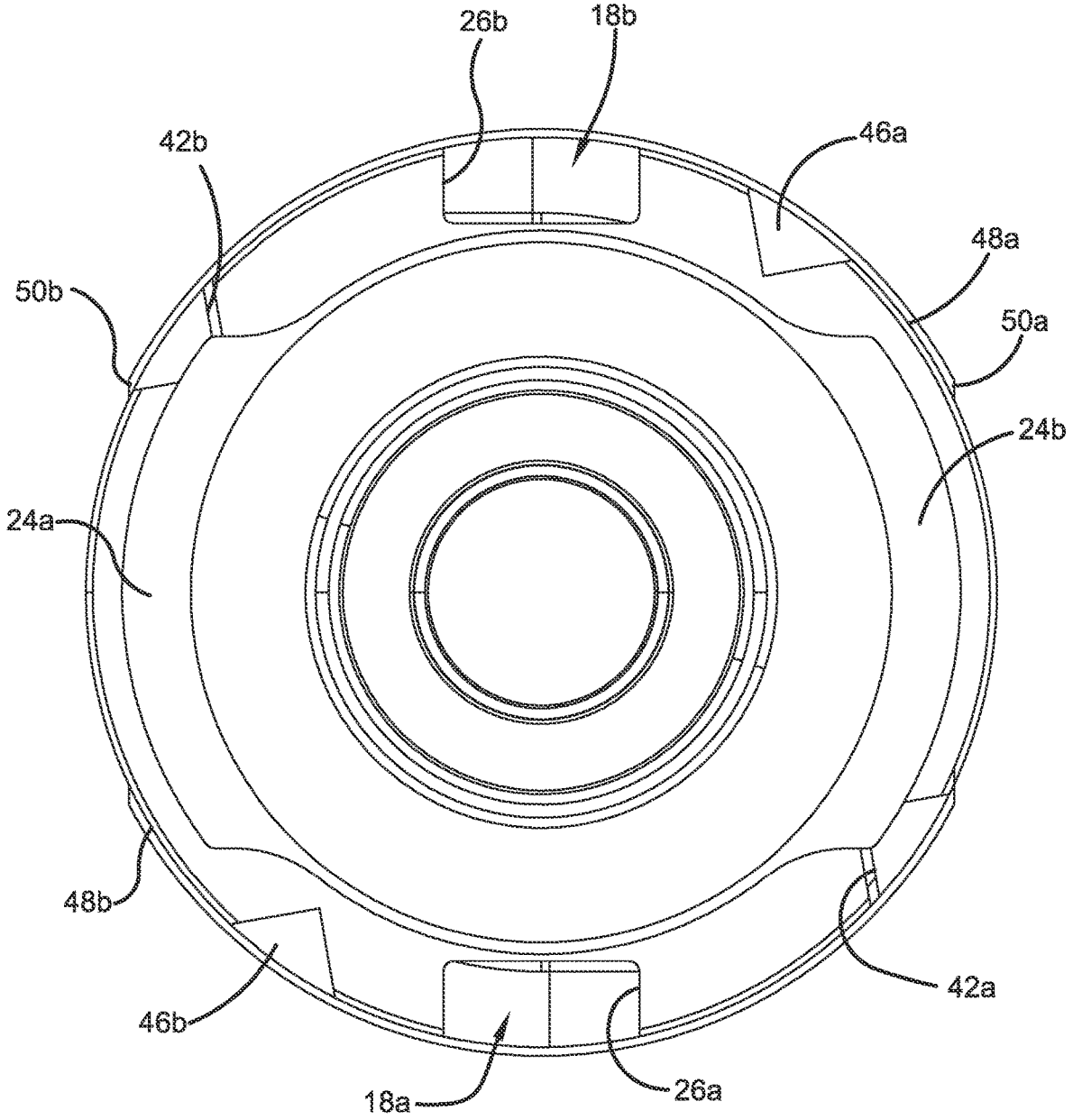
FIG. 3 is a rear elevation view of the quick-change barrel.
Figure 4:
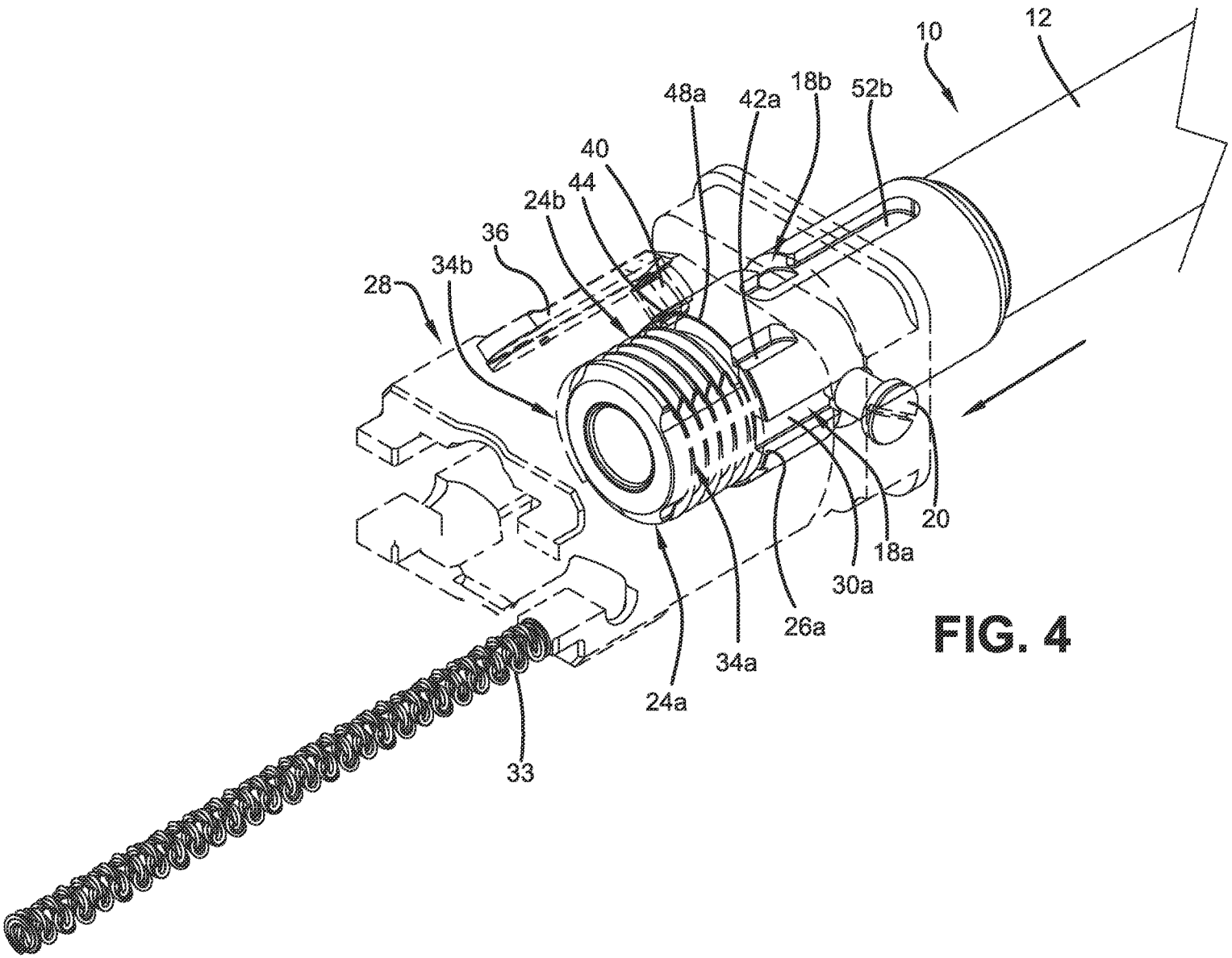
FIG. 4 is a perspective view of the initial mounting of the quick-change barrel to a firearm in accordance with a particular embodiment, and some portions are drawn as visible behind other portions.
Figure 5:
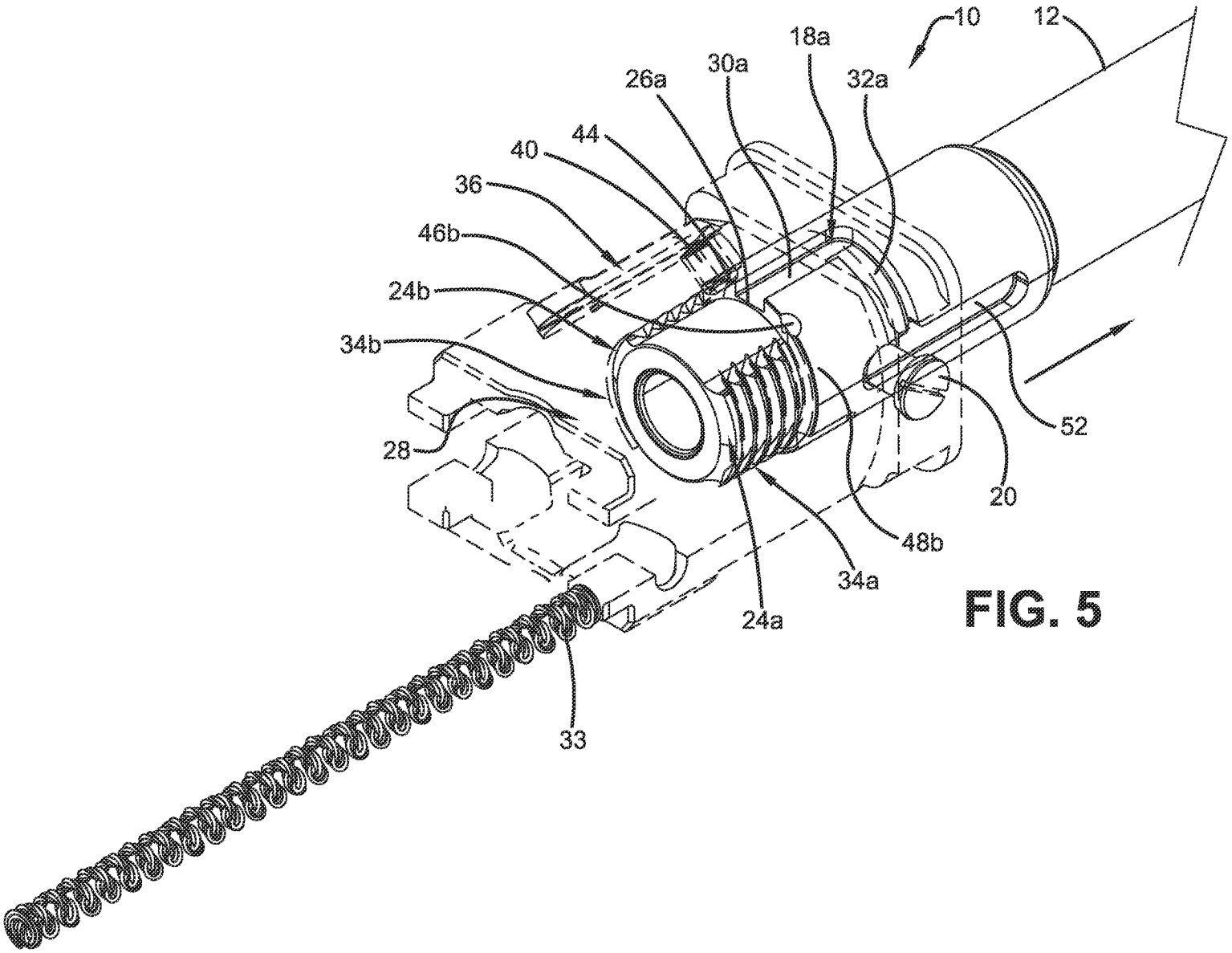
FIG. 5 is a perspective view of the locked position after mounting of the quick-change barrel to the firearm of FIG. 4, and some portions are drawn as visible behind other portions.

With reference to FIGS. 1-3, an embodiment of a quick-change barrel in accordance with this invention is shown and designated by the numeral 10. The quick-change barrel 10 has an elongate body 12 with a muzzle 14 and a mounting end 16 opposite the muzzle 14. In the embodiment shown, the mounting end 16 includes a first barrel-mounting feature 18*a* and a second barrel-mounting feature 18*b*, separated circumferentially. Referring to FIGS. 4 and 5, each barrel-mounting feature 18*a*, 18*b* is configured to selectively interact with a barrel-receipt feature 20 of a firearm during mounting of the quick-change barrel 10 to the firearm. By selecting which barrel-mounting feature 18*a*, 18*b* is to interact with the barrel-receipt feature 20, the quick-change barrel 10 is selectively mountable to the firearm in at least two orientations.

Here, the barrel-mounting features 18*a*, 18*b* are barrel slots, and the barrel-receipt feature 20 is an alignment stud, but it will be appreciated that other interacting structures could be employed. Interacting geometries on the barrel and firearm serve to achieve proper alignment and mounting, with the selection of a given geometry on the barrel serving to orient the barrel in a first orientation, and selection of a second or third etc. geometry serving to orient the barrel in second, third, etc. orientations.

The barrel 10 could be made to have a single stud as barrel-mounting feature while the firearm could be made to have two or more slots as barrel-receipt features (i.e. the reverse of the embodiment shown here, which avoids providing a barrel with a protruding stud, opting instead for slots). Thus, the present invention provides a quick-change barrel for a firearm either including at least two barrel-mounting features, each configured to selectively interact with a barrel-receipt feature of the firearm, or including at least two barrel-receipt features of the firearm, each configured to selectively interact with a barrel-mounting feature of the barrel used during mounting of the quick-change barrel to the firearm, such that the quick-change barrel is selectively mountable to the firearm in at least two orientations depending either upon which of the at least two barrel-mounting features interact with the barrel-receipt feature or which of the at least two barrel-receipt features interact with the barrel-mounting feature.

In disclosing other embodiments of this invention, the terms barrel-mounting feature and barrel-receipt feature are removed in favor of focusing on the use of barrel slots 18*a*, 18*b* and an alignment stud 20, as in the particular, non-limiting embodiments shown in the figures.

In FIG. 5, a locked position in a first orientation is shown in which the first barrel slot 18*a* interacts with the alignment stud 20. The quick-change barrel 10 can be mounted in a second orientation by instead mounting the quick-change barrel 10 such that the second barrel slot 18*b* interacts with the alignment stud 20. This improves the prior art by allowing for a second (and in some embodiments, a third or fourth or more) orientation for mounting the quick-change barrel to a firearm, making it easier to find an initial mounting orientation, and providing a second mounting orientation should wear or damage or debris compromise a first one of the barrel slots 18*a*, 18*b*. If one of the barrel slots becomes damaged or otherwise blocked or rendered inoperable so as to eliminate the possibility that the barrel can be installed in that orientation using that barrel slot, then one of the other barrel slots can still be successfully used to install the barrel in that other barrel slot's position or orientation.

The present invention also allows the barrel to be quickly inserted or removed without requiring the actuation or manipulation of any push buttons, levers, or locking or retaining mechanisms. Thus, though not required, in some embodiments, the barrel can be inserted and/or removed without requiring the actuation or manipulation of any push buttons, levers, handles, rings, locking mechanisms, retainers, holders, aligners, or the opening, closing or manipulation of any partitions, doors, receiver sections, covers, guards, or anything else designed or intended to act as a barrel retaining or position holding/locking device.

The mounting end 16 provides a lock extension 22. In the embodiment shown, the lock extension 22 includes a first set of barrel locking flanges 24*a* and a second set of barrel locking flanges 24*b*. The first set of barrel locking flanges 24*a* is positioned circumferentially between a first slot entrance 26*a* to the first barrel slot 18*a* and a second slot entrance 26*b* to the second barrel slot 18*b*, and the second set of barrel locking flanges 24*b* is positioned circumferentially between the second slot entrance 26*b* to the second barrel slot 18*b* and the first slot entrance 26*a* to the first barrel slot 18*a*. The absence of the barrel locking flanges 24*a*, 24*b* about the circumference at the lock extension 22 provides room for the alignment stud 20 to pass to the entrance 26*a*, 26*b* of a selected barrel slot 18*a*, 18*b*, in the mounting of the quick-change barrel 10 to a firearm.

Mounting of the quick-change barrel 10 in a first orientation can be appreciated from FIGS. 4 and 5. As seen in FIG. 4, the quick-change barrel 10 is oriented with one of the slot entrances, here, the first slot entrance 26*a*, aligned with the alignment stud 20, and the mounting end 16 is inserted into a barrel-mounting structure 28 so that the alignment stud 20 enters an axial section 30*a* of the first barrel slot 18*a*. The axial section 30*a* communicates with a circumferential section 32*a* of the first barrel slot 18*a*, and, once the alignment stud 20 reaches the circumferential section 32*a*, the barrel 10 is rotated to a locked position, as shown in FIG. 5. In this embodiment, the barrel-mounting structure 28 is a barrel extension mounted to the firearm f Other mounting structures can be employed to practice the present invention.

As seen in comparison of FIGS. 4 and 5, the barrel locking flanges 24*a*, 24*b* are configured to interact with first and second sets of locking flanges 34*a*, 34*b* provided by the barrel-mounting structure 28, in order to axially lock in the quick-change barrel 10. As seen, the flanges 34*a* prevent axial movement of the quick-change barrel 10 by blocking axial movement of the barrel locking flanges 24*a*, as also occurs with flanges 34*b* and 24*b*.

In some embodiments, the first and second barrel slots 18*a*, 18*b* are identical such that mounting of the quick-change barrel 10 in a second orientation is achieved by instead aligning the second slot entrance 26*b* with the alignment stud 20, and inserting the mounting end 16 into the barrel-mounting structure 28 so that the alignment stud 20 enters an axial section 30*b* of the second barrel slot 18*b*. The axial section 30*b* communicates with a circumferential section 32*b* of the first barrel slot 18*b*, and, once the alignment stud 20 reaches the circumferential section 32*b*, the barrel 10 is rotated to a locked position.

Figure 6:
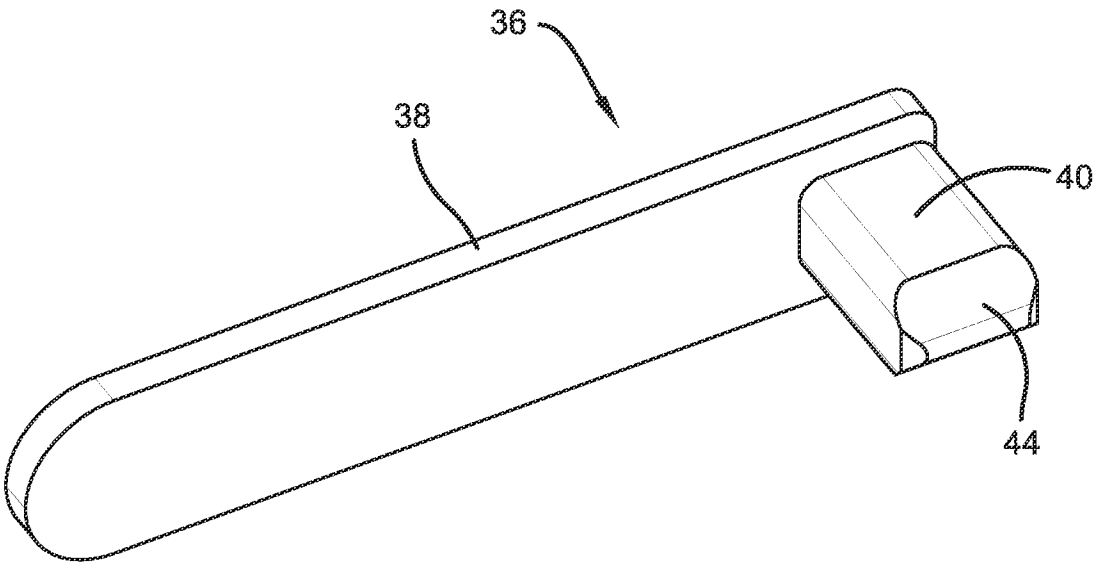
FIG. 6 is a perspective view of a retaining spring use in some embodiments of the invention.

In some embodiments, the firearm includes a barrel retaining spring 36. As seen in FIGS. 4-6, the retaining spring 36 includes an elongate spring leaf 38 having a locking tip 40 extending from an end thereof, the other end secured to the barrel-mounting structure 28 to allow the spring leaf 38 to flex as necessary to permit the locking tip 40 to engage a notch associated with the locked position of a given mounting orientation. The barrel 10 includes a first notch 42*a* positioned relative to the first barrel slot 18*a* so as to receive the locking tip 40 when the barrel 10 is mounted with the alignment stud 20 interacting with the first barrel slot 18*a* and turned to the locked position (FIG. 5). Similarly, the barrel 10 includes a second notch 42*b* positioned relative to the second barrel slot 18*b* so as to receive the locking tip 40 when the barrel 10 is mounted with the alignment stud 20 interacting with the second barrel slot 18*b* and turned to the locked position.

In some embodiments, the locking tip 40 includes a beveled lead end 44 to ramp over a first feed ramp 46*a*. The first feed ramp 46*a* is positioned relative to the first barrel slot 18*a* so as to appropriately align with the beveled lead end 44 as the barrel 10 is initially inserted for mounting, with the alignment stud 20 interacting with the first barrel slot 18*a* (FIG. 4). As the barrel 10 is inserted, the beveled lead end 44 ramps over the first feed ramp 46*a*, and rests on a first land 48*a*. Upon rotation to the locked position (FIG. 5), the first land 48*a* moves under the locking tip 40, and the first notch 42*a* comes to receive the locking tip 40 to hold the barrel against easy rotational movement. With a general roundedness to the sides of the locking tip, appropriate rotational force can overcome the retaining spring 36 and allow removal of the barrel through the reversal of the disclosed mounting steps. Similarly, the second feed ramp 46*b* is positioned relative to the second barrel slot 18*b* so as to appropriately align with the beveled lead end 44 as the barrel 10 is initially inserted for mounting, with the alignment stud 20 interacting with the second barrel slot 18*b*. As the barrel 10 is inserted, the beveled lead end 44 ramps over the second feed ramp 46*b*, and rests on a second land 48*b*. Upon rotation to the locked position, the second land 48*b* moves under the locking tip 40, and the second notch 42*b* comes to receive the locking tip 40 to hold the barrel against easy rotational movement. Removal is also similar.

It will be appreciated that the barrel 10 as shown includes first and second barrel slots 18*a*, 18*b*, with the slots 18*a*, 18*b* themselves, and the features associated with each slot 18*a*, 18*b* (i.e., feed ramps and notches) being offset 180 degrees to provide symmetrically offset mounting orientations. It will be appreciated this same concept could be applied to provide a quick-change barrel with at least three or at least four or more orientations. In the example embodiments provided, the limit in the number of potential orientations would be based on the sizing of slots and the circumferential surface area for a given barrel.

In some embodiments, the barrel 10 includes one or more tactile features (for example tactile features 50*a*, 50*b*), provided to help the user properly orient the barrel 10 relative to the mounting structure 28 to initiate mounting of the barrel 10 to the firearm. In this example, the tactile features 50*a*, 50*b* are flats on the barrel oriented 90 degrees offset from respective slot entrances 26*a*, 26*b* so that, when a chosen flat is oriented topmost, its respective slot entrance is oriented to align with the alignment stud 20, thus facilitating a quick change of the quick-change barrel 10. The relative positioning of one or more tactile features can be chosen in various ways, with the intent to assist the user in positioning the barrel in the proper orientation for initial insertion with a barrel-mounting feature interacting with the barrel-receipt feature. As examples only, a tactile feature may be provided in circumferential alignment with a barrel-mounting feature (so that the user positions the tactile feature at the circumferential location of the barrel-receipt feature to ensure alignment), and could alternatively be provided offset circumferentially from the barrel-mounting feature (so that the positioning of the tactile feature at a particular location relative to the firearm f—for example, at the topmost position (12 o'clock) described above-places the barrel-mounting feature in the correct location for insertion). In some embodiments, a tactile feature is selected from alignment indicators, flats, marks, lines, protrusions, or other machined or added surfaces, indicators, devices or other features provided so that the correct barrel orientation can quickly be determined for rapid barrel installation, and in the event of a damaged or inoperable barrel slot or position, one or more of the other available barrel orientations can be quickly and easily determined.

In some embodiments, as seen in FIG. 5, the locked position places the alignment stud 20 in a cycle section 52*a* of the first barrel slot 18*a*—and, similarly, if the second barrel slot 18*b* were chosen for mounting the quick-change barrel, the locked position would place the alignment stud 20 in a cycle section 52*b* of the second barrel slot 18*b*. These cycle sections 52*a*, 52*b* exist at the end of their respective circumferential sections 32*a*, 32*b*, and extend axially to allow the barrel 10 to move back and forth relative to the alignment stud 20. This is describer more particularly below.

In some embodiments, the mounting structure 28 is a barrel extension, and the alignment stud 20 is secured to a trunnion bearing 54 that remains in a fixed position in the firearm's receiver, as the barrel extension, the quick-change barrel, and the retaining spring reciprocate back and forth as the firearm cycles. In such embodiments, the barrel extension (mounting structure 28) is spring-loaded (as represented by spring 33) to move relative to the trunnion bearing 54/alignment stud 20. When inserting the quick-change barrel 10 in such embodiments, the spring 33 is slightly compressed as the distal end of the barrel 10 contacts the interior of the barrel extension and pushes it to move away from the alignment stud 20 as the barrel 10 is moved to place the alignment stud 20 at the elbow defining the transition to a circumferential section 32*a* or 32*b* (as the case may be depending on the slot 18*a*, 18*b* chosen for mounting). After rotation to place the barrel 10 in the locked position, the spring pushes back on the barrel extension and places the alignment stud 20 at a rest portion 56*a*, 56*b* of the cycle section 52*a*, 52*b*.

In embodiments with at least two barrel-receipt features provided by the firearm and a barrel-mounting feature provided by the quick-change barrel, the barrel-receipt features can be first and second slots substantially as slots 18*a*, 18*b*, but provided by the firearm, for example, in a trunnion bearing, with locking flanges of the barrel interacting with locking flanges in a barrel extension. The slots in the firearm/trunnion could be formed with axial, circumferential, and cycle sections to allow the barrel and barrel extension to cycle. This is all substantially as disclosed, but with the converse placement of barrel-receipt and barrel-mounting features.

Notably this embodiment with a spring-loaded barrel extension still allows the barrel to be inserted and/or removed without requiring the actuation or manipulation of any push buttons, levers, handles, rings, locking mechanisms, retainers, holders, aligners, or the opening, closing or manipulation of any partitions, doors, receiver sections, covers, guards, or anything else designed or intended to act as a barrel retaining or position holding/locking device.

In some embodiments, the barrel can be inserted and/or removed in one fluid motion with the use of just one hand without requiring anything more than a [simple] push-and-twist movement. This provides a quick-change barrel that is actually a one-handed, quick-change design with no other special/complex manipulation required.

In light of the foregoing, it should be appreciated that the present invention significantly advances the art by providing a quick-change barrel that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

ELEMENT LIST FOR FIGURES

10 Quick-Change Barrel
12 Elongate Body
14 Muzzle
16 Mounting End
18*a* First Barrel-Mounting Feature [First Barrel Slot]
18*b* Second Barrel-Mounting Feature [Second Barrel Slot]
20 Barrel-Receipt Feature [Alignment Stud]
22 Lock Extension
24*a* First Set of Barrel Locking Flanges
24*b* Second Set of Barrel Locking Flanges
26*a* First Slot Entrance
26*b* Second Slot Entrance
28 Mounting Structure
30*a* Axial Section [First Barrel Slot]
30*b* Axial Section [Second Barrel Slot]
32*a* Circumferential Section [First Barrel Slot]
32*b* Circumferential Section [Second Barrel Slot]
33 Spring
34*a* First Set of Locking Flanges
34*b* Second Set of Locking Flanges
36 Barrel Retaining Spring
38 Spring Leaf
40 Locking Tip
42*a* First Notch
42*b* Second Notch
44 Beveled Lead End
46*a* First Feed Ramp
46*b* Second Feed Ramp

48*a* First Land
48*b* Second Land
50*a* Tactile Feature
50*b* Tactile Feature
52*a* Cycle Section [First Barrel Slot]
52*b* Cycle Section [Second Barrel Slot]
54 Trunnion Bearing
56*a* Rest Portion [First Barrel Slot]
56*b* Rest Portion [Second Barrel Slot]

What is claimed is:

1. A firearm comprising:

a quick-change barrel including:

at least two barrel-mounting features, each configured to selectively interact with a barrel-receipt feature of the firearm during mounting of the quick-change barrel to a mounting structure of the firearm, such that the quick-change barrel is selectively mountable to the firearm in at least two orientations depending upon which of the at least two barrel-mounting features interact with the barrel-receipt feature, wherein, in the at least two orientations, one of the at least two barrel-mounting features does not interact with a barrel-receipt feature of the firearm, and the quick-change barrel is axially locked in the mounting structure with the same headspace in each of the at least two orientations.

2. The firearm of claim 1, further comprising at least one tactile feature positioned relative to at least one of the barrel-mounting features so as to indicate a correct barrel orientation for initial insertion of the quick-change barrel in the barrel-receipt feature.

3. The firearm of claim 1, wherein (a) the at least two barrel-mounting features include a first barrel slot and a second barrel slot, and the barrel-receipt feature is an alignment stud, or wherein (b) the at least two barrel-receipt features include a first barrel support slot in the firearm and a second barrel support slot in the firearm, and the at least one barrel-mounting feature is an alignment stud.

4. The firearm of claim 1, wherein the quick-change barrel further comprises barrel locking flanges configured to (i) interact with locking flanges of the mounting structure during mounting of the quick-change barrel in the at least two orientations and (ii) axially lock the quick-change barrel in the mounting structure with the same headspace in each of the at least two orientations.

5. A firearm comprising:

a quick-change barrel including:

(a) at least two barrel-mounting features, each configured to selectively interact with a barrel-receipt feature of the firearm during mounting of the quick-change barrel to a mounting structure of the firearm, or (b) at least one barrel-mounting feature configured to selectively interact with at least two barrel-receipt features of the firearm during mounting of the quick-change barrel to a mounting structure of the firearm, such that the quick-change barrel is selectively mountable to the firearm in at least two orientations depending, per (a), upon which of the at least two barrel-mounting features interact with the barrel-receipt feature or, per (b), upon which of the at least two barrel-receipt features interact with the barrel-mounting feature; and barrel locking flanges configured to engage locking flanges provided by the mounting structure, wherein (a) the at least two barrel-mounting features include a first barrel slot and a second barrel slot, and the barrel-receipt feature is an alignment stud, or wherein (b) the at least two barrel-receipt features include a first barrel support slot in the firearm and a second barrel support slot in the firearm, and the at least one barrel-mounting feature is an alignment stud.

6. The firearm of claim 5, wherein the mounting structure is a barrel extension.

7. The firearm of claim 5, wherein the quick-change barrel includes at least two barrel-mounting features including a first barrel slot and a second barrel slot, and the barrel-receipt feature is an alignment stud, and the barrel locking flanges include at least two sets of locking flanges extending radially at a mounting end of the quick-change barrel, the locking flanges being spaced circumferentially about the insertion end.

8. The firearm of claim 7, wherein each set of the at least two sets of locking flanges are positioned circumferentially about the quick-change barrel, between two of the at least two barrel-mounting features.

9. A firearm comprising:

a quick-change barrel including:

(a) at least two barrel-mounting features, each configured to selectively interact with a barrel-receipt feature of the firearm during mounting of the quick-change barrel to a mounting structure of the firearm, or (b) at least one barrel-mounting feature configured to selectively interact with at least two barrel-receipt features of the firearm during mounting of the quick-change barrel to a mounting structure of the firearm, such that the quick-change barrel is selectively mountable to the firearm in at least two orientations depending, per (a), upon which of the at least two barrel-mounting features interact with the barrel-receipt feature or, per (b), upon which of the at least two barrel-receipt features interact with the barrel-mounting feature;

wherein (a) the at least two barrel-mounting features include a first barrel slot and a second barrel slot, and the barrel-receipt feature is an alignment stud, or wherein (b) the at least two barrel-receipt features include a first barrel support slot in the firearm and a second barrel support slot in the firearm, and the at least one barrel-mounting feature is an alignment stud; and wherein the first barrel slot comprises:

a first slot entrance section;

a first circumferential section;

a first cycle section;

wherein the first slot entrance section extends axially along the length of the barrel and is in communication with the first circumferential section, wherein the first circumferential section is in communication with the first cycle section, and wherein the first cycle section is oriented axially with the length of the barrel;

wherein the second barrel slot comprises:

a second slot entrance section;

a second circumferential section;

a second cycle section; and wherein the second slot entrance section extends axially along the length of the barrel and is in communication with the second circumferential section, wherein the second circumferential section is in communication with the second cycle section, and wherein the second cycle section is oriented axially with the length of the barrel.

10. The firearm of claim 9, wherein, when the quick-change barrel is in a locked position, the alignment stud is in communication with the first cycle section or the second cycle section.

11. The firearm of claim 9, wherein the firearm includes a barrel retaining spring, and the quick-change barrel further comprises a first notch and a second notch, both for selectively interacting with the barrel retaining spring.

12. The firearm of claim 11, wherein the quick-change barrel further comprises:

a first feed ramp;

a second feed ramp;

wherein the first feed ramp is positioned relative to the first barrel slot for alignment with the locking tip of the barrel retaining spring during installation of the quick-change barrel in a first orientation of the at least two orientations;

wherein the second feed ramp is positioned relative to the second barrel slot for alignment with the locking tip of the barrel retaining spring during installation of the quick-change barrel in a second orientation of the at least two orientations;

a first landing, wherein the first landing is positioned behind the first feed ramp and is circumferentially adjacent to the first notch; and a second landing, wherein the second landing is positioned behind the second feed ramp and is circumferentially adjacent to the second notch.

13. The firearm of claim 12, wherein the locking tip includes a beveled lead end configured to (a) ramp over the first feed ramp onto the first landing and engage the first notch upon rotation of the quick-change barrel into the locked position in the first orientation, and (b) ramp over the second feed ramp onto the second landing and engage the second notch upon rotation of the quick-change barrel into the locked position in the second orientation.

14. A firearm comprising:

a quick-change barrel including:

(a) at least two barrel-mounting features, each configured to selectively interact with a barrel-receipt feature of the firearm during mounting of the quick-change barrel to a mounting structure of the firearm, or (b) at least one barrel-mounting feature configured to selectively interact with at least two barrel-receipt features of the firearm during mounting of the quick-change barrel to a mounting structure of the firearm, such that the quick-change barrel is selectively mountable to the firearm in at least two orientations depending, per (a), upon which of the at least two barrel-mounting features interact with the barrel-receipt feature or, per (b), upon which of the at least two barrel-receipt features interact with the barrel-mounting feature; and wherein the quick-change barrel is configured so that the quick-change barrel can be mounted to and removed from the firearm without requiring the actuation or manipulation of any push buttons, levers, handles, rings, locking mechanisms, retainers, holders, aligners, or the opening, closing or manipulation of any partitions, doors, receiver sections, covers, guards, or anything else designed or intended to act as a barrel retaining or position holding/locking device.

15. The quick-change barrel of claim 14 where the quick-change barrel can be mounted to or removed from the firearm with a push-and-twist movement.

16. A quick-change barrel for a firearm comprising:

at least two barrel-mounting features, each configured to selectively interact with a barrel-receipt feature of the firearm during mounting of the quick-change barrel to the firearm, such that the quick-change barrel is selectively mountable to the firearm in at least two orientations depending upon which of the at least two barrel-mounting features interact with the barrel-receipt feature, wherein the at least two barrel-mounting features include a first barrel slot and a second barrel slot, and wherein the first barrel slot comprises:

a first slot entrance section;

a first circumferential section;

a first cycle section;

wherein the first slot entrance section extends axially along the length of the barrel and is in communication with the first circumferential section, wherein the first circumferential section is in communication with the first cycle section, and wherein the first cycle section is oriented axially with the length of the barrel;

wherein the second barrel slot comprises:

a second slot entrance section;

a second circumferential section;

a second cycle section; and wherein the second slot entrance section extends axially along the length of the barrel and is in communication with the second circumferential section, wherein the second circumferential section is in communication with the second cycle section, and wherein the second cycle section is oriented axially with the length of the barrel.

17. A firearm comprising:

at least two barrel-receipt features, each configured to selectively interact with a barrel-mounting feature of a quick-change barrel during mounting of the quick-change barrel to a mounting structure of the firearm, such that the firearm can selectively receive a quick-change in at least two mounted orientations depending upon which of the at least two barrel-receipt features interact with the barrel-mounting feature;

wherein the at least two barrel-receipt features include a first barrel slot and a second barrel slot, and wherein the first barrel slot comprises:

a first slot entrance section;

a first circumferential section;

a first cycle section;

wherein the first slot entrance section extends axially along the length of the firearm and is in communication with the first circumferential section, wherein the first circumferential section is in communication with the first cycle section, and wherein the first cycle section is oriented axially with the length of the firearm;

wherein the second barrel slot comprises:

a second slot entrance section;

a second circumferential section;

a second cycle section; and wherein the second slot entrance section extends axially along the length of the firearm and is in communication with the second circumferential section, wherein the second circumferential section is in communication with the second cycle section, and wherein the second cycle section is oriented axially with the length of the firearm.

18. A firearm comprising:

a quick-change barrel including at least one barrel-mounting feature configured to selectively interact with at least two barrel-receipt features of the firearm during mounting of the quick-change barrel to a mounting structure of the firearm, such that the quick-change barrel is selectively mountable to the firearm in at least two orientations depending upon which of the at least two barrel-receipt fixtures interact with the barrel-mounting fixture, wherein, in the at least two orientations, one of the at least two barrel-receipt features does not interact with the at least one barrel-mounting feature.

* * * * *